US010219568B1

(12) United States Patent
Saluan

(10) Patent No.: US 10,219,568 B1
(45) Date of Patent: Mar. 5, 2019

(54) SURGICAL CAP TO CONTROL PATIENT BODY TEMPERATURE

(75) Inventor: Paul Saluan, Hinckley, OH (US)

(73) Assignee: EQUALIZER TECHNOLOGY LLC, Rocky River, OH (US)

( * ) Notice: Subject to any disclaimer, the term of this patent is extended or adjusted under 35 U.S.C. 154(b) by 238 days.

(21) Appl. No.: 12/649,887

(22) Filed: Dec. 30, 2009

(51) Int. Cl.
*A42B 1/04* (2006.01)

(52) U.S. Cl.
CPC ..... *A42B 1/04* (2013.01)

(58) Field of Classification Search
CPC ..... A42B 1/008; A42B 1/004; A42B 1/04
USPC ..... 2/171–174, 181, 181.2, 68, 195.1
See application file for complete search history.

(56) References Cited

U.S. PATENT DOCUMENTS 430,003 A * 6/1890 De Lacy ..... A42B 1/043 2/209.5
1,798,024 A * 3/1931 McBride ..... A42B 1/12 2/68
1,819,558 A * 8/1931 Husman ..... A42B 1/045 2/174
2,193,271 A * 3/1940 Cowherd ..... A42B 1/041 2/171
2,417,323 A * 3/1947 Richards ..... A42B 1/12 2/68
2,644,949 A * 7/1953 Greenberg ..... A42B 1/069 2/172
2,726,398 A * 12/1955 Cooper ..... A42B 1/12 2/174
2,885,683 A * 5/1959 Lipkin ..... A42B 1/066 2/172
2,983,925 A * 5/1961 Gettinger ..... A42B 1/045 2/204
D190,849 S * 7/1961 Rudolph ..... D2/880
3,296,582 A * 1/1967 Ide ..... G10K 11/002 181/0.5
3,321,774 A * 5/1967 Tames ..... A42B 1/043 2/181
D214,482 S * 6/1969 Zimmon et al. ..... D2/867
3,512,181 A * 5/1970 Osborne ..... A42B 1/043 2/181.2
3,555,565 A * 1/1971 Zimmon et al. ..... A42B 1/043 2/195.7
3,872,516 A * 3/1975 Bird ..... A42B 1/045 2/202
4,061,898 A * 12/1977 Murray ..... A42B 1/008 219/211
4,491,985 A * 1/1985 Dalton ..... A42B 1/041 2/172
4,552,149 A * 11/1985 Tatsuki ..... A42B 1/008 607/110
4,572,173 A * 2/1986 Comeau ..... A61F 13/12 128/849
4,951,319 A * 8/1990 Phillips, Jr. ..... A42B 1/04 2/172
5,197,292 A * 3/1993 McPherson ..... A42B 1/008 2/7

(Continued)

*Primary Examiner* — Richale L Quinn
(74) *Attorney, Agent, or Firm* — John D. Gugliotta

(57) ABSTRACT

The present invention relates generally to a device and a method that maintains a patient's body temperature during surgical exposure and, more specifically, to a surgical, insulative cap that is contoured to the patient's head. The instant abstract is neither intended to define the invention disclosed in this specification nor intended to limit the scope of the invention in any way.

6 Claims, 5 Drawing Sheets

(56) References Cited

U.S. PATENT DOCUMENTS

RE35,290 E * 7/1996 Druskoczi ..... A61F 5/055 128/DIG. 23
5,557,807 A * 9/1996 Hujar ..... A42B 1/008 2/171.2
5,565,154 A * 10/1996 McGregor ..... B32B 5/26 264/45.4
5,594,956 A * 1/1997 Barrientos ..... A42B 1/041 2/171
5,850,636 A * 12/1998 Reuven ..... A42B 1/008 2/174
5,887,285 A * 3/1999 McCormick ..... A42C 5/04 2/171.1
6,014,776 A * 1/2000 DeVinzio ..... A42B 1/041 2/171
6,112,332 A * 9/2000 McCormick ..... A42C 5/04 2/171
6,247,181 B1 * 6/2001 Hirsch ..... A42B 1/041 2/171
6,467,096 B1 * 10/2002 Coluccio ..... A42B 1/22 2/171
D473,365 S * 4/2003 Bias ..... D2/867
6,557,179 B1 * 5/2003 Reuven ..... A42B 1/008 2/171.2
6,820,283 B2 * 11/2004 Graneto, III ..... A45D 19/14 2/171.2
6,904,617 B2 * 6/2005 Tsai ..... A41D 13/0053 2/209.13
6,948,189 B2 * 9/2005 Early ..... A42C 1/00 2/184.5
D517,284 S * 3/2006 Black ..... D2/867
7,930,768 B1 * 4/2011 Tyler ..... A42B 1/041 2/173
2004/0163162 A1 * 8/2004 Benziger ..... A42B 1/08 2/411
2007/0000024 A1 * 1/2007 Kozul ..... A42B 1/041 2/171
2007/0006364 A1 * 1/2007 Brewer ..... A42B 1/069 2/171
2011/0010823 A1 * 1/2011 Horgan ..... A42B 1/041 2/171

* cited by examiner

SURGICAL CAP TO CONTROL PATIENT BODY TEMPERATURE

RELATED APPLICATIONS

The present invention is generally related to the subject matter described in the following applications:

U.S. Ser. No. 10/821,820 filed on Aug. 9, 2004

U.S. Ser. No. 11/804,172, filed on May 11, 2007;

U.S. Pat. No. D584,000, issued on Dec. 30, 2008; and

U.S. patent application Ser. No. 29/361,933, filed on May 18, 2010.

BACKGROUND OF THE INVENTION

1. Field of the Invention

The present invention relates generally to a device and a method that maintains a patient's body temperature during surgical exposure and, more specifically, to a surgical, insulative cap that is contoured to the patient's head.

2. Description of the Related Art

The vast majority of patients that undergo anesthetic experience some level of hypothermia. The decrease in temperature is variable, but it worsens in the procedures that involve larger and lengthier surgical exposures. The state of relative hypothermia can significantly and adversely affect a patient, especially during the perioperative and the postoperative periods. Complications related to hypothermia include myocardia ischemia, hypertension, tachycardia, and the infections that lead to unanticipated mortality and morbidity. Because most of a patient's heat capacity is lost through an uncovered head, the medical industry is combating the problem by developing a means to keep the patient euthermic.

One such means is the Surgical Garment for a Patient taught in U.S. Pat. No. 5,887,279 to Elting et al., wherein a hood piece that covers the head and the entire neck of a patient comprises a polypropylene fabric. A disadvantage to Elting is that it covers the possible sites for the central line access obtained through the neck region. A closure must be opened to strategically place an intravenous tube or a monitor sensor in the region; however, there is no means taught in Elting to prevent the opened closure from obstructing the central venous access.

U.S. Pat. No. 6,178,562 to Elkins teaches a heat exchange component that includes a central rear lobe and a pair of opposing side lobes that conform to a human head. Although Elkin specifically discloses the importance of the surface area covered by a heat exchange component, Elkin does not teach an embodiment that covers the wearer's ears. Because most heat escapes through the head and the extremities, including the ears, it is important that a surgical cap cover the ears.

The present invention is distinct from the foregoing patents and overcomes their respective disadvantages by teaching a surgical, insulative cap that is designed both to contour a patient's head and ears and to maintain its position during surgery.

SUMMARY OF THE INVENTION

It is an object of the present invention to provide a flexible and a disposable surgical cap that is worn by patients during surgical procedures. It is an object of the present invention to reduce the risks to patients, especially to the elderly patients at higher risks, for developing hypertension, tachycardia and the other conditions related to surgical hypothermia. It is an object that the present cap is comprised of an insulative material that is both stretchable and flexible to provide a means for the cap to follow the contour of a head.

It is an object that the present surgical cap is constructed to minimize exposures to fibrous materials and, as such, to remove any habitat for bacterial growth.

It is envisioned that the present surgical cap includes an insulative inner portion and a shell fabricated from the materials sold under the trademarks THERMALITE®, THINSULATE® or OUTLAST®. More specifically, the cap includes a ceramic fiber material, a commercially synthetic material having fibers that contain a plurality of microencapsulated and paraffinic hydrocarbons (hereinafter a "phase change material") and a synthetic microfiber having a composition approximating 65% olefin and 35% polyester. The cap extends over a greater portion of a patient's forehead, over the patient's ears and behind the head to reach as far as the top of the lumbar spine. It is an object of the present cap to prevent excessive airflow between the cap material and a patient's head by eliminating the large air gap between the two. This object is accomplished by minimizing the amount of surface area covered by the cap while also retaining the cap on the patient's head. It is envisioned that a reflective material may be incorporated into the disclosed invention. Reflective materials may be added to the fibrous insulative materials.

It is an object of the present invention to provide a means to adjust the surgical cap to further ensure a close-fit. It is an object that such means includes gusseted portions with an attachment mechanism selected from the group comprising VELCRO™ or a chemical adhesive having a peel-away protective cover. It is an object of the present invention to provide a chin strap as a means to ensure the grip of the surgical cap to the head. It is envisioned that the chin strap is attached to the lower right and the lower left aspects of the surgical cap.

It is a final object of the present invention to provide all of the advantages that the foregoing objects entail. The present invention departs from the current designs to overcome their respective disadvantages. The present invention will maintain its position during and after the repeated times an anesthesiologist manipulates the head's position to access monitor apparatuses. The present invention continues to provide access to the central venous region. The present invention may similarly be used for nonsurgical patients with temperature regulatory issues, s.a., immunocompromised individuals and cancer patients.

BRIEF DESCRIPTION OF THE DRAWINGS

The advantages and the features of the present invention will become better understood with reference to the following more detailed description and the claims taken in conjunction with the accompanying drawings, in which like elements are identified with like symbols, and in which:

DESCRIPTION OF THE PREFERRED EMBODIMENTS

Figure 1:
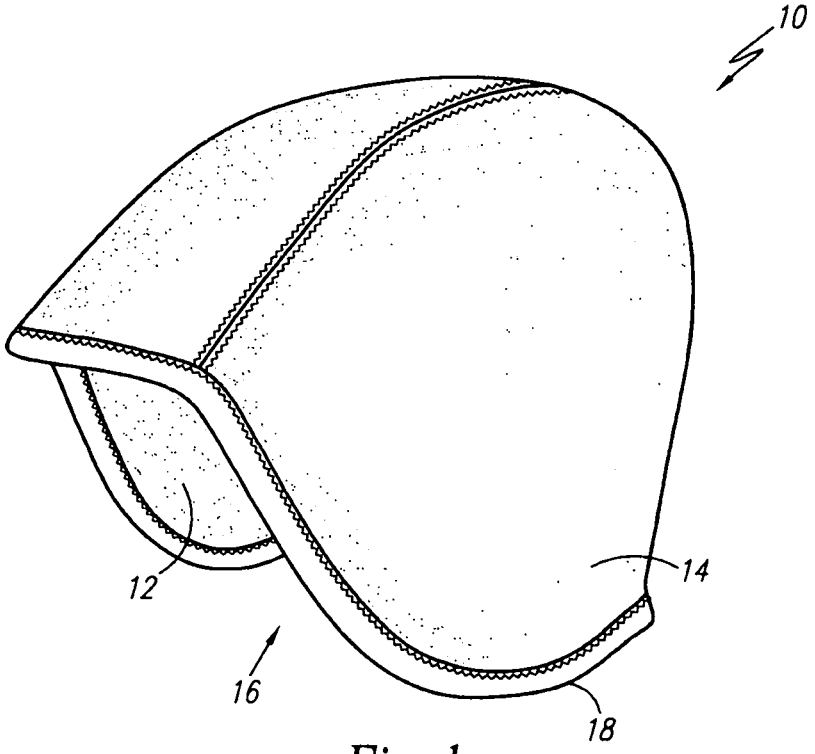
FIG. 1 is a perspective view of a Surgical Cap to Control Patient Body Temperature according to a preferred embodiment of the present invention.

The best mode for carrying out the invention is presented in terms of its preferred embodiment, herein depicted within the FIGS. 1-7.

1. Detailed Description of the Figures

Referring now to FIG. 1-5, a covering unit, generally noted as 10, is shown for covering a patient's head for maintaining the head temperature and core body temperature within euthermic range during surgery. The covering unit 10 covers a substantial portion of the head 70, as will be described in greater detail below and forms a multi-part shell component having an inner surface 12 adapted for closely fitting the contours of a patient's head so as to prevent open air space between the head and an inner surface. The shell component further has an outer surface 14, and forming an opening 16 circumscribed by a gripping lower edge 18. This gripping lower edge 18 forms a gripping means for gripping to a patient's head in a manner such as to impede said the head covering unit from coming off of the patient's head during surgery. The shell component preferrably will provide insulating properties, and may include an insulating filling. However, in greater detail as shown in FIG. 6, the material of the shell component is anticipated as being thicker than 1 mm and less than 2 mm thick and adapted for positioning over both lateral side portions of the head. This shell is of a thickness suitable for maintaining the patient's head temperature within euthermic range.

Figure 5:
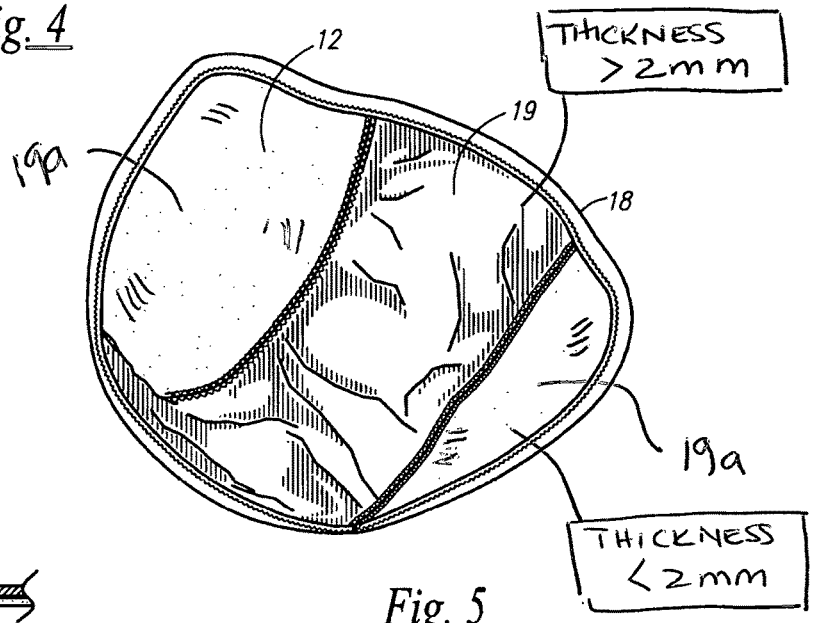
FIG. 5 is a reverse perspective showing the inner portion thereof.
Figure 6:
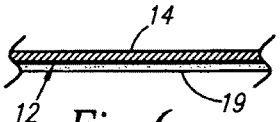
FIG. 6 is a partial cross sectional view taken along lines VI-VI of FIG. 4.
Figure 7:
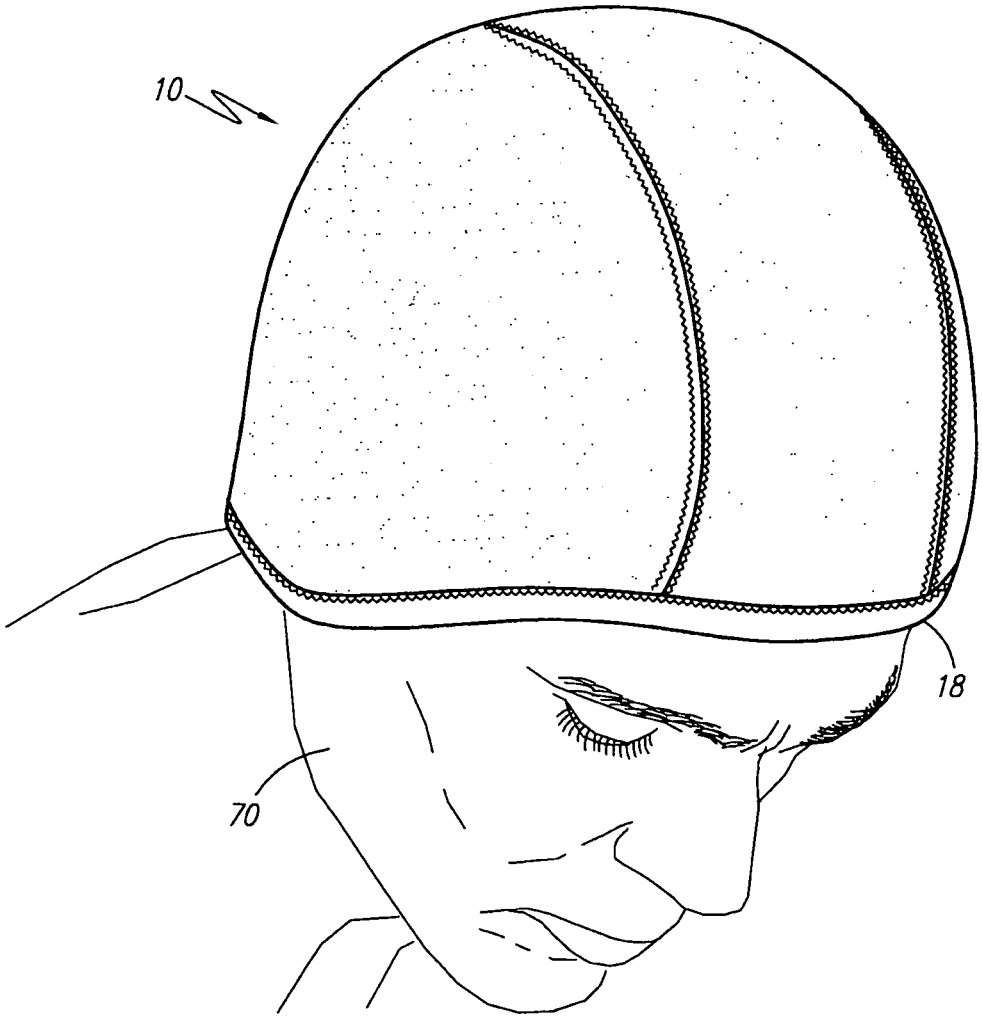
FIG. 7 is a perspective view of a surgical sap to control patient body temperature according to a preferred embodiment of the present invention, wherein the surgical cap is shown in cooperation with a wearer's head; and, FIG. 8 is a perspective view of a surgical cap to control patient body temperature according to an alternate embodiment of the present invention.

As additionally anticipated and shown best in conjunction with FIG. 5-6, an additional insulating component 19 lining a portion of the inner surface 12. The insulating component 19 lining the top center panel is provided having a greater thickness to cover areas adapted to cover the posterior, the anterior and the top portions of said head. The thickness may be greater than 2 mm. Further, the lateral portions of the insulating component 19*a* lining the first side panel and the second side panel further may have a lesser thickness at both lateral side portions of the head. This thickness may be less than 2 mm.

Also illustrated in FIG. 1-7, the cap 10 will preferably cover below the mid point of the external auditory meatus bilaterally in addition to the rear portion of the head and upper neck region. The material covering the head has been designed to be in contact with the head in all covered areas so as to prevent a signification amount of air space between the head and the inner material covering the head. To accomplish this, the shell component is made from a pattern cut that is asymmetric from a section of the covering unit adapted for covering the front of the head and a section of the covering unit adapted for covering the rear of the head covering unit, such that the pattern cut has a concave pattern so as to emulate the shape of the front and rear of the head to prohibit the head covering unit from coming off of the head during surgery.

It is preferred that the shell component comprise insulative properties. The shell component may further include an insulative filling.

It is anticipated that the material of the shell component, as shown in FIG. 6, approximates a thickness no less than 1-mm and preferably between 1-mm and 2-mm or greater. The shell's thickness is not limited to the approximations disclosed herein, but may alternatively comprise any thickness that both maintains euthermic range and adapts to a position over both lateral portions of the patient's head.

It is additionally anticipated that an additional insulative component 19 lines a portion of the inner surface 12, as best shown in FIGS. 5 and 6. The insulative component 19 comprises material having a thickness greater than 2-mm at the areas adapted to cover the posterior, the anterior and the top portions of the head. The insulative component 19 comprises material having a thickness less than 2-mm at the areas adapted to cover both of the lateral portions.

The surgical cover 10 insulates a greater portion of the patient's head along approximately the central third, the anterior and the posterior portions. As also illustrated in FIGS. 1-7, the surgical cap 10 preferably covers below the midpoint of the external auditory meatus bilaterally in addition to the rear portion of the head and the upper neck region. The inner material that covers the head is designed to be in direct contact with the head to prevent the adverse effects a surgical cap having air gaps has on patient hypothermia. The direct contact is accomplished by means of a shell component made from a pattern cut asymmetrically from a section of the covering unit adapted to cover the front of the head and from a section of the covering unit adapted to cover the rear of the head. The pattern cut is concave to emulate the shape of the front and the rear of a head; it prohibits the surgical cap 10 from falling off during surgery. The pattern forms a gap less than ¾ inch, preferably less than ½ inch and most preferably less than ¼ inch.

It is additionally contemplated that the surgical cap 10 include material that comprises a temperature regulating microfiber. The enclosed cap may further incorporate a chin strap attached to the lower right and the lower left aspects of the surgical cover 10.

It is envisioned that the cap 10 is manufactured in various sizes, e.g., the standard sizes that include extra-small, small, medium, large, extra-large and the like. For a more efficient fit, the surgical cap 10 may comprise the various standard sizes for different age ranges. Additionally, an adjustment or a take-up mechanism may be used to ensure a close-fit over the patient's head without pressing on the patient's head. The surgical cap 10 laterally grips below the patient's external auditory meatus. Finally, it is envisioned that the material used in the head covering unit does not emit sparks nor is it static conductive. It may even be made of a fire retardant material.

Figure 2:
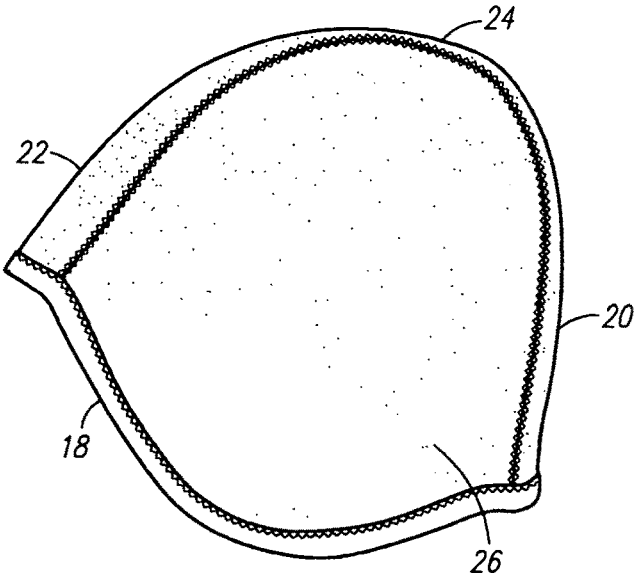
FIG. 2 is a side elevational view thereof.
Figure 3:
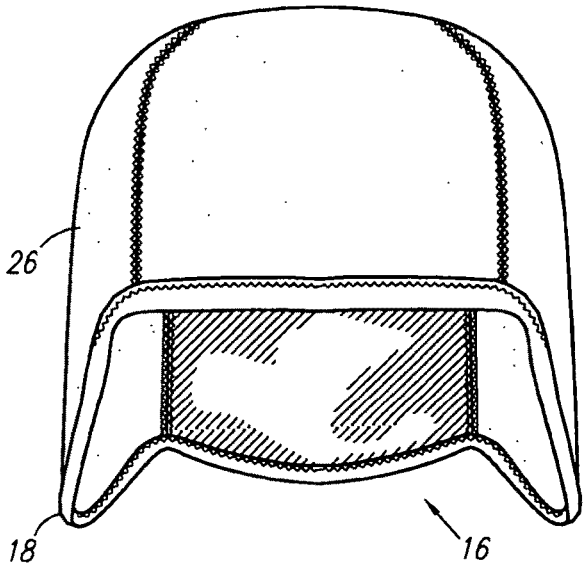
FIG. 3 is a front elevational view thereof.
Figure 4:
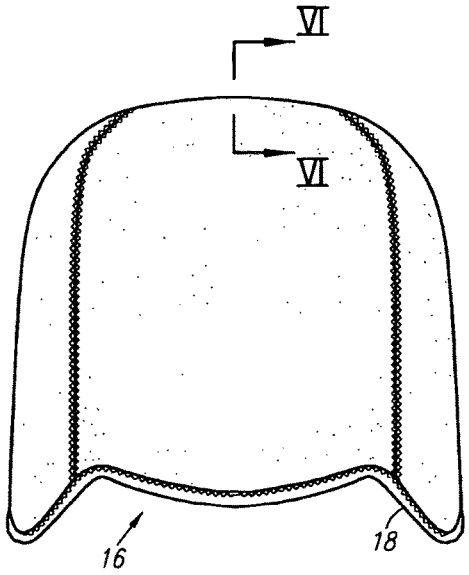
FIG. 4 is a rear elevational view thereof.

FIGS. 1-3 further illustrate that an embodiment of the disclosed invention can be made from a pattern cut asymmetrically from a section of the surgical cap 10 adapted to cover the front of the head and a section of the surgical cap 10 adapted to cover the rear of the head. Such a pattern is concave to emulate the shape of the front and the rear of the head and to prohibit the head covering unit from falling off during surgery. This embodiment includes a rear panel 20, a front panel 22, a top panel 24, and a medial and a lateral side panel 26 covering the mid point of the external auditory meatus bilaterally. The seams between the sides contain the external aspects to prevent the surgical cap 10 from moving when it is laid on the posterior side, the medial or lateral side of the body.

FIGS. 1-3 further illustrated that an example of the disclosed invention can be made from a pattern cut that is asymmetric from a section of the covering unit adapted for covering the front of the head and a section of the covering unit adapted for covering the rear of the head covering unit. Such a pattern cut has a concave pattern so as to emulate the shape of the front and rear of the head to prohibit the head covering unit from coming off of the head during surgery, and includes a rear panel 20, a front panel 22, a top panel 24, a medial and lateral side panel 26 covering the mid point of the external auditory meatus bilaterally. The seams between the sides containing external aspects so as to contain the head from movement when laying on the posterior side, or the medial or lateral side of the body.

Figure 8:
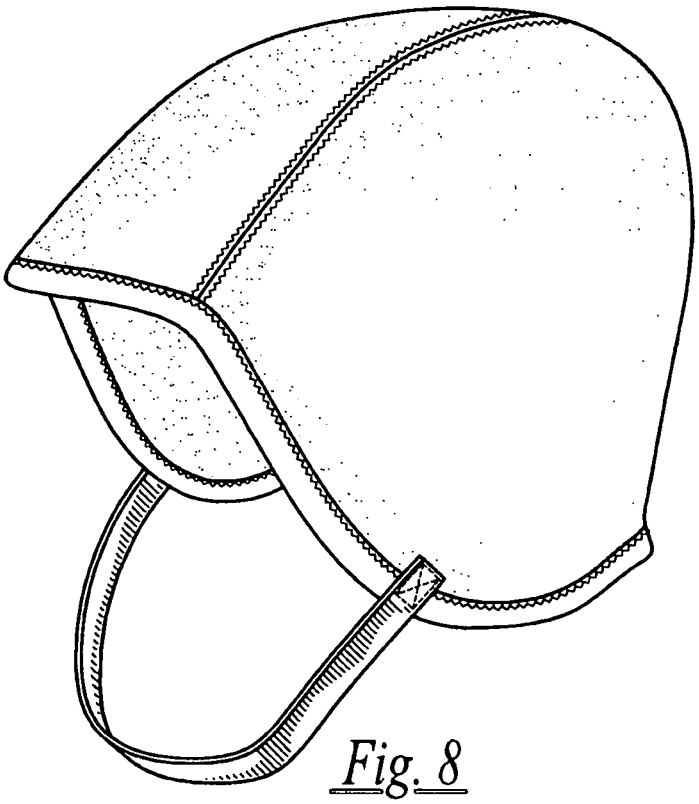

Referring now to FIG. 8, a perspective view of a Surgical Cap for Controlling Patient Body Temperature according to an alternate embodiment of the present invention that includes an additional chinstrap 80 attached to the covering unit 10 across the opening 16 and at the lower edge 18. While the chinstrap 80 is intended to provide additional protection for the prevention of maintaining said head covering on the patient's head during surgery.

2. Operation of the Preferred Embodiment

In operation, the present invention the covering unit 10 is anticipated for use in maintaining the head temperature and core body temperature within euthermic range during or after surgery. The patient's head 70 is covered at the forehead, ears and a base having a back portion along a line where the head and neck meet. The covering unit 10 is closely fitted to the head 70 and maintains a close proximity throughout surgery. The head covering 10 provides further additional insulation at least a portion of a patient's head during surgery. The cap 10 is made such as to grippingly engage below the wearer's external auditory meatus bilaterally and conform closely to the patient's head.

The foregoing descriptions of the specific embodiments of the present invention have been presented for the purposes of illustration and description only. They are not intended to be exhaustive nor are they intended to limit the invention to the precise forms disclosed and, obviously, many modifications and variations are possible in light of the above teaching. The embodiments were chosen and described in order to best explain the principles of the invention and its practical application, to thereby enable others skilled in the art to best utilize the invention and its various embodiments with various modifications as are suited to the particular use contemplated. It is intended that the scope of the invention be defined by the Claims appended hereto and their equivalents. Therefore, the scope of the invention is to be limited only by the following claims.

Having thus described the invention, what is claimed as new and desired and to be secured by Letters Patent is as follows:

1. A surgical cap to maintain a patient's optimal body temperature during a surgical procedure, said surgical cap comprises:

an insulative element having an entire area that closely fits a portion of said patient's head and ears;

a shell component having an inner surface, an outer surface and a lower edge, said inner surface is attached to said insulative element without any voids or pockets formed there between;

a first side panel;

a second side panel;

a top center panel that forms a front, a center and a rear connected to said first side panel and said second side panel; and a means to grip formed of a medial and a lateral side panel adapted to cover in close proximity a mid point of the external auditory meatus bilaterally, said means contains the head from shifting and moving when said surgical cap is laid on the posterior, the medial or the lateral side of the body, wherein said insulative element lining the top center panel comprises material having a thickness greater than 2-mm on the areas adapted to cover the posterior, the anterior and the top portions of said head.

2. A surgical cap to maintain a patient's optimal body temperature during a surgical procedure, said surgical cap comprises:

an insulative element having an entire area that closely fits a portion of said patient's head and ears;

a shell component having an inner surface, an outer surface and a lower edge, said inner surface is attached to said insulative element without any voids or pockets formed there between;

a first side panel;

a second side panel;

a top center panel that forms a front, a center and a rear connected to said first side panel and said second side panel; and a means to grip formed of a medial and a lateral side panel adapted to cover in close proximity a mid point of the external auditory meatus bilaterally, said means contains the head from shifting and moving when said surgical cap is laid on the posterior, the medial or the lateral side of the body, wherein said insulative element lining the first side panel and the second side panel further comprises material having a thickness less than 2-mm at the areas adapted to cover both lateral side portions of the head.

3. The surgical cap of claim 1, wherein said insulative element is made of a synthetic microfiber having a composition of approximately 65% olefin and 35% polyester.

4. The surgical cap of claim 1, wherein said patient's optimal body temperature during a surgical procedure is a specified temperature range within minus two degrees from the euthermic temperature.

5. The surgical cap of claim 2, wherein said patient's optimal body temperature during a surgical procedure is a specified temperature range within minus two degrees from the euthermic temperature.

6. The surgical cap of claim 2, wherein said insulative element is made of a synthetic microfiber having a composition of approximately 65% olefin and 35% polyester.

* * * * *